United States Patent [19]

Eddy et al.

[11] B 3,981,485

[45] Sept. 21, 1976

[54] HELICOPTER TRANSPORTABLE DRILLING RIG

[75] Inventors: Kenneth Harmon Eddy; Kenneth Harmon McGill, both of Beaumont, Tex.

[73] Assignee: Dresser Industries, Inc., Dallas, Tex.

[22] Filed: Oct. 2, 1974

[21] Appl. No.: 511,407

[44] Published under the second Trial Voluntary Protest Program on February 10, 1976 as document No. B 511,407.

[52] U.S. Cl. ..... 254/186 R; 60/718; 74/661

[51] Int. Cl.[2] ..... B66D 1/14

[58] Field of Search ..... 254/186 R, 187 A, 173 R; 74/661, 722; 60/718, 716; 417/360

[56] References Cited

UNITED STATES PATENTS

| | | | |
|---|---|---|---|
| 2,405,546 | 8/1946 | Archer | 74/661 |
| 2,613,059 | 10/1952 | Maier | 74/661 |
| 2,650,065 | 8/1953 | Young | 254/187 A |
| 2,651,947 | 9/1953 | Wilson | 74/722 |
| 2,784,557 | 3/1957 | Wilson | 74/661 |
| 2,936,654 | 5/1960 | Wilson | 74/661 |
| 3,079,811 | 3/1963 | Isenberg | 74/661 |
| 3,767,329 | 10/1973 | Houck | 417/360 |

*Primary Examiner*—M. H. Wood, Jr.
*Assistant Examiner*—John A. Pekar
*Attorney, Agent, or Firm*—Michael J. Caddell

[57] ABSTRACT

A portable drilling rig which may be disassembled into subcomponent packages small enough to be transported to the site by helicopter and quickly reassembled utilizes unique chain drive units, compound arrangement and drawworks assembly.

15 Claims, 7 Drawing Figures

HELICOPTER TRANSPORTABLE DRILLING RIG

BACKGROUND OF THE INVENTION

In the production of hydrocarbons from underground formations located in Alaska, Canada, Peru, Indonesia, and any region where ground transportation is restricted or non-existent during all or part of the year, and in drilling for oil from offshore locations, and in remote jungle locations, it often becomes necessary to transport by air the materials and equipment needed to drill and explore for the oil.

Due to the cumbersome size and weight of the equipment comprising the average drilling rig, much of the rig must be tediously disassembled piece-by-piece and flown in by large air transport. This normally requires disassembly of the heavy chain drive units, the final drive unit, and the drawworks for movement to the drilling site. This requires a timely and expensive reassembly at the site with a complicated realignment of the reassembled machinery. It often necessitates disassembly of each of the chain case assemblies which means draining of the oil and extensive protection to prevent contamination of the chains and sprockets with dirt, water, and other debris. Then the chain cases must be reassembled on site, often a task near impossible in subzero blizzard conditions or during heaving storms at sea.

Even though the art has progressed enough to place many individual components each on their own portable skid, these must be moved by ship to offshore locations or by large air transport to northern regions because of their extreme weight.

When weather condtions or lack of roads and airfields prevent the use of ships or airplanes, the driller must resort to helicopter transportation of the rigs which requires that each of the usual skid packages must be broken down even further due to the relatively light carrying capacity of the helicopters available. This cancels the portability advantage of the normal skid units since reassembly of their components requires almost as much time as that of the older rigs did.

The present invention overcomes the limitations of the prior devices by providing a drilling rig compound comprised entirely of subcomponents each of which is an integral package transportable by helicopter and easily assimilated together to form a drilling rig of any desirable size or capacity. Each subcomponent is fully portable and is below the maximum weight transportable by helicopter, and each subcomponent is easily joined with the others without lengthy adjustment or realignment needed. In the present invention, the chain drive assemblies, often termed chain cases, are integral, sealed units each helicopter transportable without requiring any disassembly of the chains or sprockets from the cases. Also the final drive assembly utilizes a split transmission drive, with each transmission being an integral unit which is helicopter transportable. The drawworks also utilizes a drum drive and brake assemblies which can be broken up into separate transportable units capable of quick reconnection on site without need for alignment or adjustment.

DESCRIPTION OF THE PREFERRED EMBODIMENTS

The present invention comprises a drilling rig comprised of component packages each of which is an integral unit transportable by helicopter to the drilling site and easily reassimilated into a drilling rig of almost any capacity desirable. The number of prime movers may be increased or decreased without difficulty and without changing the portability of the unit.

Figure 1:
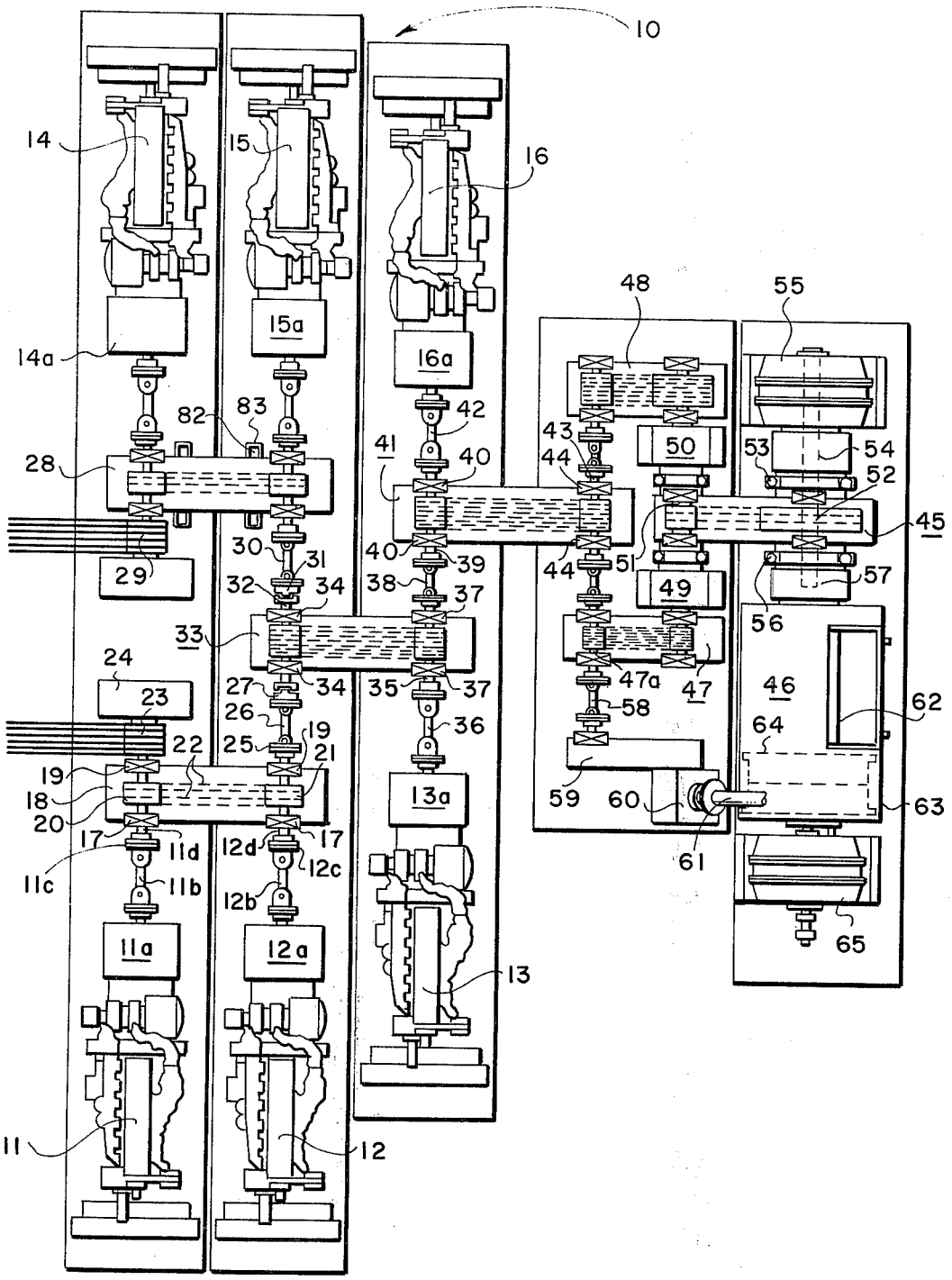
FIG. 1 is a plan view of the drilling rig layout.

FIG. 1 illustrates the unique structure and layout of the compound 10 and the drawworks and the components making up these assemblies. In the figure, a compound is shown utilizing six internal combustion engines for power, arranged in a unique compact arrangement particularly suited for offshore rigs and mountainous areas or any place where space is at a premium.

In the compound 10, half of the engines (11, 12, and 13) are aligned adjacent to each other and the other half of the engines (14, 15, and 16) lie adjacent to each other opposite engines 11, 12, and 13. As pictured, the engines will provide rotary power through transmissions attached thereto, with the transmissions 11*a*, 12*a*, and 13*a* engaged in forward speeds while the transmissions 14*a*, 15*a* and 16*a* are engaged in reverse. Since all the engines rotate in the same direction initially, by having half of them opposed to the other half, three of the transmissions must run in reverse to obtain all final rotation in the same direction.

Engines 11 and 12, working through their transmissions, drive propeller shafts 11*b* and 12*b* which, acting through disconnectable couplings 11*c* and 12*c*, turn sprocket shafts 11*d* and 12*d*. The sprocket shafts are permanently mounted in bearings 17 which in turn are secured in the side of the chain case 18. The sprocket shafts 11*d* and 12*d* extend laterally through the chain case 18 through bearings 19 securedly attached in the opposite wall of the chain case. Each of the shafts 11*d* and 12*d* carry chain drive sprockets 20 and 21 thereon inside the chain case 18. The chain drive sprockets 20 on shaft 11*d* are drivably connected to the sprockets 21 on shaft 12*d* by roller drive chains 22.

Sprocket shaft 11d extends through a bearing 19 and has keyed thereon a multiple V-belt drive pulley or sheaves 23 for driving V-belts to mudpumps elsewhere on the rig (not shown). A clutch 24 is located at the end of the shaft 11*d* to engage and disengage the mudpumps from shaft 11d.

Shaft 12*d* extends through a chain case bearing 19 and carries at its end a disconnectable coupling 25 also connected to an intermediate propeller shaft 26 which in turn is attached to a disconnectable clutch 27.

The location, assembly and operation of engines 14 and 15, and chain case 28 is an identical mirror image of that of engines 11 and 12 except for the direction of rotation which is reversed in transmissions 14*a* and 15*a* to correspond to the rotational direction of engines 11 and 12. A similar mudpump drive assembly 29 is also driven from engine 14. Likewise, chain case 28 drives through an intermediate shaft 30 and clutch 31 to work with shaft 26 and drive a sprocket shaft 32 extending through chain case 33 in side-wall bearings 34 similar to bearings 17 and 19.

Thus, it can be seen that, other than the power take-off to the mudpumps through sheaves 23 and 29, the combined power output of engines 11, 12, 14, and 15 ends up driving sprocket shaft 32 in chain case 33. This in turn drives a sprocket shaft 35 in chain case 33 which shaft is also driven by engine 13 through transmission 13a and propeller shaft 36. At the opposite end of sprocket shaft 35, which shaft turns in bearings 37 secured in the side of case 33, is connected an intermediate propeller shaft 38 coupled to another sprocket shaft 39 which is held by bearings 40 in an input chain case 41. The power from engines 11 through 15 is coupled through the propeller shaft 42 with the power of engine 16 and transmitted from sprocket shaft 39 via roller chains in the input case 41 to the input drive shaft 43 passing through case 41 in sidewall bearings 44.

The total power flow from all of the prime movers 11–16, except that which is provided through the power take-off to the mudpumps, is routed to the input shaft 43 in chain case 41 from whence it moves through a split transmission into the drum drive case 45 to power the main drum assembly 46.

The split transmission comprises a high speed transmission 47 driven off one end of shaft 43 and a low speed transmission 48 driven off of the opposite end of shaft 43. The two transmissions 47 and 48 operating through clutches 49 and 50, respectively, are connected to the drum drive shaft 51 which is connected via roller chains in case 45 to main drive shaft 52, shown in phantom in FIG. 1.

Main drive shaft 52 is coupled through coupling 53 to auxiliary brake shaft 54 containing auxiliary brake 55. The opposite end of main shaft 52 is coupled via coupling 56 to drum shaft 57. Main shaft 52 is supported in sidewall bearings in case 45 just as is drum drive shaft 51. The high speed transmission 47 also drives through auxiliary shaft 58 a catworks drive assembly 59 having a right angle gear box 60 connected by propeller shaft 61 to the catworks, usually located above the drawworks.

The main drum assembly 46 has a main drawworks drum 62, a drum housing 63, a main drum brake assembly 64, (shown in phantom in FIG. 1) and may have an optional auxiliary brake assembly 65.

In operation, the prime-mover motive power accumulates in chain case 41 and is routed either through the high speed transmission 47 and clutch 49 or the low speed transmission 48 and clutch 50 to the drum drive case 45. There the power is transferred to main shaft 52 which in turn is connected to auxiliary brake assembly 55 and to the drum drive shaft 57 which turns the main drawworks drum 62. Rotation of the drum can be controlled by the various clutches in the above described system as well as by the main drum brake 64 and auxiliary brakes 55 and 65.

Figure 2:
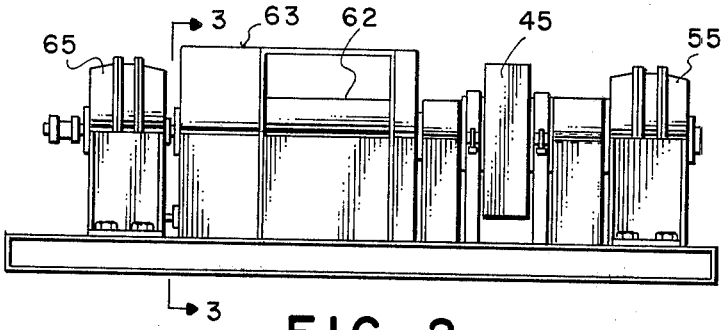
FIG. 2 is a side view of the main drum assembly.
Figure 3:
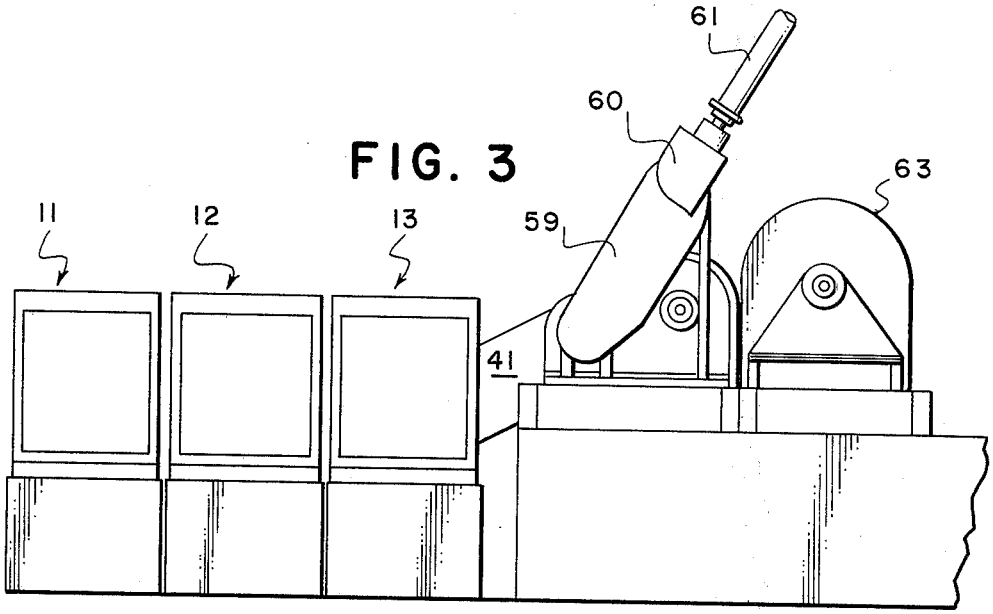
FIG. 3 is an end view of the main drum assembly and a portion of the power drive assembly.

The catworks is driven through the high speed transmission input shaft 47*a* in case 47. FIGS. 2 and 3 illustrate ground level views of the main drum assembly and the catworks drive assembly, respectively.

Figure 4:
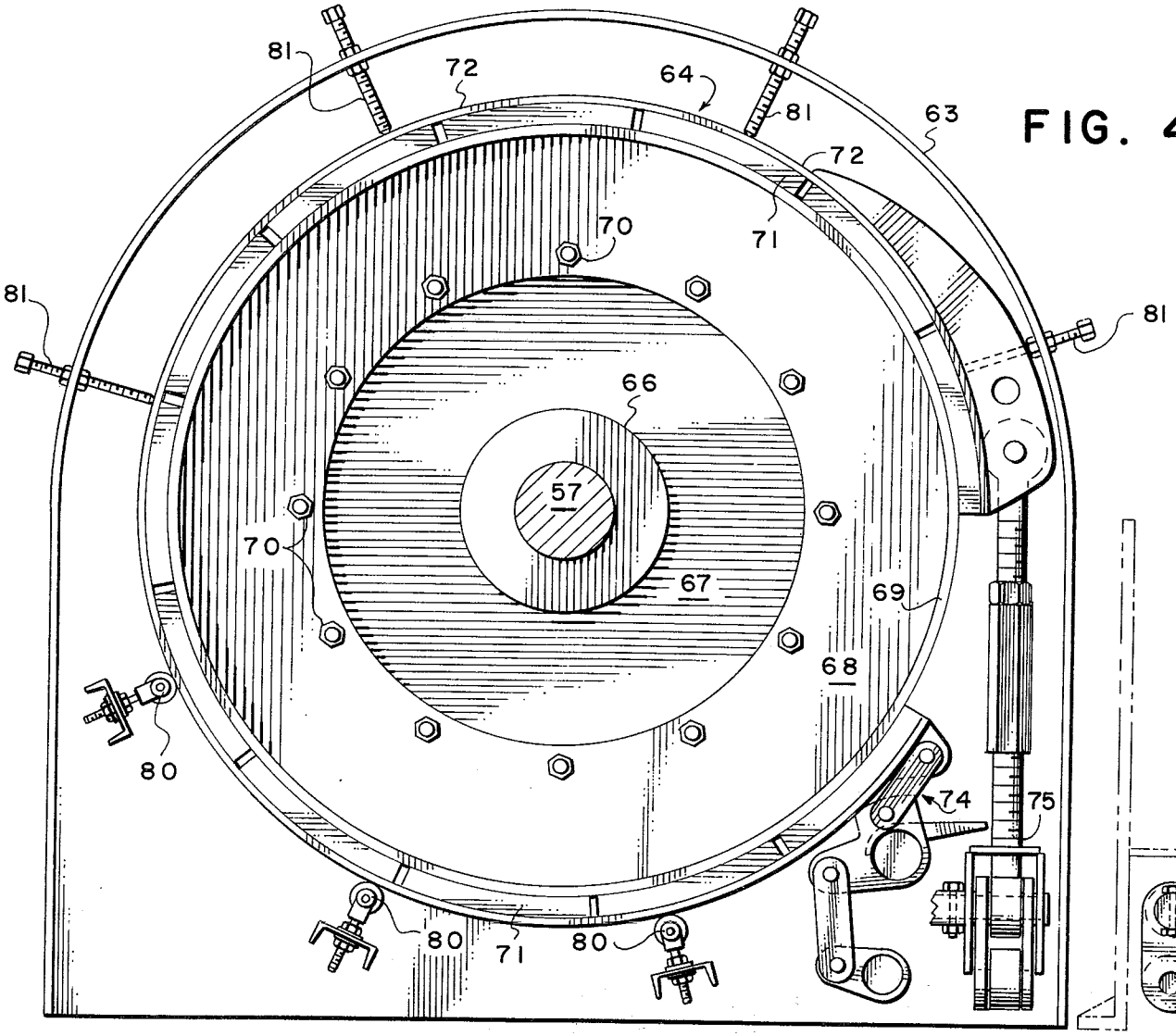
FIG. 4 is an axial end view of the main brake assembly.

FIG. 4 illustrates an axial end view of the main brake assembly 64 inside the drum housing 63 and operating on the main drum shaft 57.

The main brake assembly comprises a central hub 66 on shaft 57 securedly attached thereto, a radial web 67 integrally formed on the outer perimeter of hub 66, and the brake drum 69 attached peripherally to web 67 by means of a radially inward projecting flange 68 connected to web 67 by means of fasteners 70 or by other means such as welding. The brake shoe comprises a plurality of arcuate brake pads 71 of suitable material such as asbestos aligned in a double row peripherally around the drum 69 and contactable therewith. Arcuate brake bands 72 and 73 pass around each row of the brake pads 71 in order to clamp the pads against the drum when braking is desirable. The pads preferably are bonded or riveted to the inside surface of the brake bands. A suitable linkage 74 is attached to bands 72 and 73 to allow tightening of the bands at the operator's command.

Adjustable turnbolts 75, 76, and 77 and links 78 and 79 serve to equalize the amount of braking attained from the two brake pad assemblies. Also, the brake assembly is designed so that with the normal counterclockwise rotation of the drum the brakes are self-energizing, meaning that the brakes utilize the rotation of the drum to add increasing pressure to the brake pads against the drum. This cuts down greatly the amount of force required from the operator working the brake controls.

Rollers 80 and threaded rods 81 attached to the drum housing supply support and alignment to the brake pad assemblies particularly while the brakes are not in use.

DISASSEMBLY OF THE RIG

When the drilling rig is to be moved to the drilling site by helicopter, the entire rig is quickly broken down into integral components each below the maximum weight transportable by helicopter. Reinstalling the rig on site requires no complicated reassembly or adjustment. The rig of this invention is designed so that all the components are placed easily and quickly back into alignment and in operable condition almost instantaneously with setting them down on the rig floor.

Figure 7:
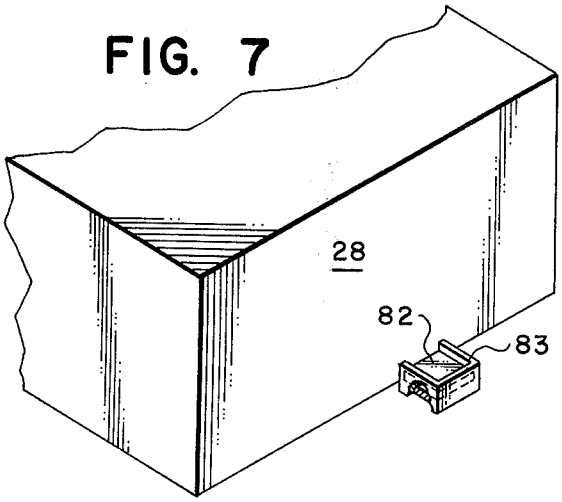
FIG. 7 is a partially cut-away view of the alignment mechanism on the chain case assemblies.
Figure 6:
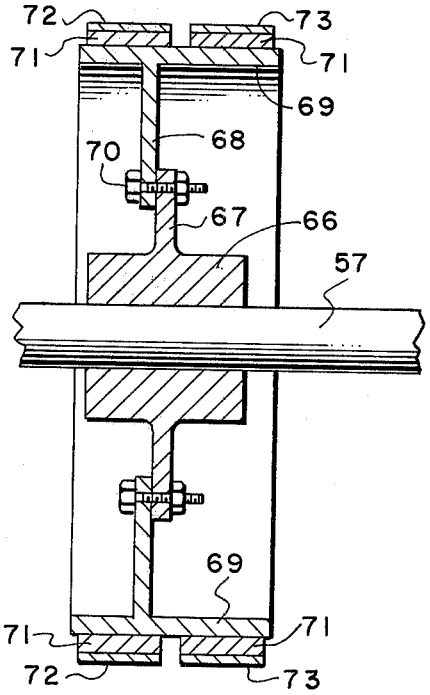
FIG. 6 is a cross-sectional view of the main drum brake assembly.
Figure 5:
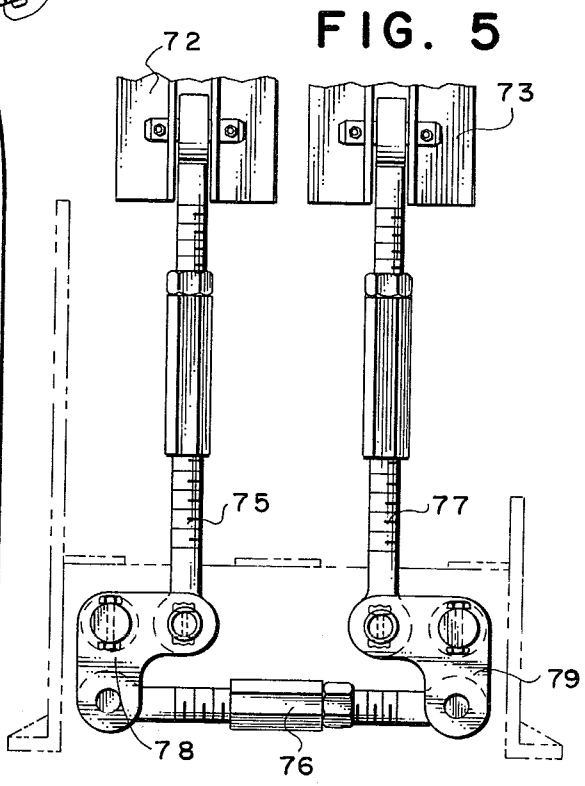
FIG. 5 is a front view of the main brake equalizing linkage.

Referring to FIG. 7, a detailed close-up of apparatus for alignment of the chain cases is disclosed. As previously described, each chain case is a separable, integral unit in itself and can be moved by helicopter from one site to another without disturbing the alignment of the chains or chain sprockets, without having to drain the lubricant therefrom, and without exposing the workings therein to contaminants or the environment.

Each chain case preferably has a plurality of "ears" 82 extending outward from several locations on the lowermost edges of the case, consisting of flat plates or angle iron.

Likewise, the skid or platform receiving or supporting each chain case has a corresponding "fence" 83 or rail attached thereto sized and located to receive the "ears" of the chain cases. Each fence may comprise a rectangular or other shaped receptacle having vertically extending sides and enclosing all of the exposed sides of the "ears" on the chain cases. The fences are preferably of the same general shape and slightly larger than the ears of the chain cases. Different chain cases could have different sized or shaped ears with matching fences to differentiate from the other units and insure the same location for each unit respective to the others when moving from one site to the next.

Each chain case generally has two sprocket shafts passing transversely therethrough, generally in parallel alignment, each being journaled in sidewall bearings in each side of the case and each carrying chain sprockets. A plurality of chains transfer power between the two sprockets carried by the shafts in each case. The cases themselves are self-contained and fluid tight and the sidewall bearings and sprocket shafts passing therethrough are fluid tight in the case walls.

When the rig is being transported, the lift cable from the helicopter is usually hooked or tied in an eyebolt or similar attachment secured to the top of each case after the couplings or clutches at each end of the sprocket shafts have been disconnected. Then the case can be lifted stright up and transported to the new site intact, whereupon it is set down in its proper place with the case ears sliding into the guide fences and the unit is ready to go upon reconnection of the various propeller shafts to the sprocket shafts. The above operation applies generaly to all of the chain cases 18, 28, 33, 41, and 45 as well as the transmissions 47 and 48.

The individual engines 11–16 are provided with eyebolts or other hook receptacle means and are helicopter transportable independently of their transmissions, radiators, and skids. Each engine is unbolted from the skid and transmission and disconnected from fuel lines and coolant lines and picked up by the helicopter. The skid, transmission, and fuel and coolant systems for each engine then travel as a single unit by helicopter.

The particular arrangement of engines is unique in that it allows the maximum number of engines with the minimum amount of space and the minimum number of power transferrance units such as chain drives and pulley drives. This compact layout allows for greater use of the limited amount of room on offshore rigs and the shortest exposure time to operating and maintenance personnel in northern regions.

In addition to the compact design of the compound further novelty resides in the layout and design of drawworks drive system and of the main drum assembly.

In the drawworks drive system a unique split-transmission arrangement to receive the accumulated prime mover force and transmit it to the drawworks utilizes two compact transportable transmissions as opposed to the old single unit two-speed transmission system. The single unit, two-speed transmission is entirely too heavy and cumbersome to be transported by helicopter, whereas each of the transmissions of this system are compact and light enough to be moved by any means, including helicopter. The split transmission includes a high speed unit and a low speed unit, each with its own clutch control into the drum drive case.

A power take-off from the high speed transmission also powers the catworks via a propeller shaft and right angle gear box. Since the high speed transmission has a clutch between it and the drum drive, the catworks may be driven whether or not the drum drive is being driven by the high speed or the low speed transmission.

The main drum assembly is also novel in that it allows quick, clean dissembly of the brake system from the main drum without disturbing the adjustment or assembly of the individual brake parts. The entire braking system is removed from the main drum assembly intact and as a system rather than in pieces.

This is possible because of the design of the main drum which places both brake assemblies at one end of the drum rather than having one brake at each end of the drum as the prior devices have.

Also, the design of the brake system with the brake bands, pads, linkage and brake drum all remaining in one package, completely assembled but separable from the main drawworks drum, means that the brake assembly can be moved by helicopter separate from the main drum and later quickly reunited therewith. This also lightens the main drum to the point that it can be similarly transported.

The auxiliary brakes preferably are both hydraulic retarding mechanisms used to partially brake the drum drive. Each is separately helicopter transportable.

Although a specific preferred embodiment of the present invention has been described in the detailed description above, the description is not intended to limit the invention to the particular forms of embodiments disclosed therein since they are to be recognized as illustrative rather than restrictive and it will be obvious to those skilled in the art that the invention is not so limited. For instance, the prime movers may be of internal combustion type as shown or some other type such as electric powered or turbines. Also the number of such engines could be more or less than that shown. Furthermore, in some instances belt drives could be used in place of the chain drives, and vice versa. Also the catworks could be driven by belt drive or chain drive or could be electically operated, rather than gear and propeller shaft driven. Thus, the invention is declared to cover all changes and modifications of the specific example of the invention herein disclosed for purposes of illustration which do not constitute departures from the spirit and scope of the invention.

The embodiments of the invention in which an exclusive property or privilege is claimed are defined as follows:

1. A power system for an oil well drilling rig, said system being constructed of integral componets each being portable and having a weight of less than about 4000 pounds, said system comprising:

a plurality of prime movers arranged in close proximity to each other;

means for receiving and mounting each of said prime movers and for transmitting power from said prime movers; said means comprising an integral, portable unit for each said prime mover;

power transfer means interconnectable with said transmitting means and adapted to receive power from at least two of said prime movers via said transmitting means and to transfer said power to an output shaft, said power transfer means comprising a plurality of integral power transfer systems, each system being an integral unit fully transportable without disassembly thereof, and each said system having easily disconnected and reconnected power input and output means;

power accumulator means for receiving the power from all of said prime movers and having alternately selective dual power outputs;

transmission means connected to said accumulator means and having a high speed transmission connected to one of said accumulator means power outputs, and a low speed transmission connected to the other of said accumulator means power outputs;

main drum drive means releasably connected to both of said transmissions and arranged to selectively receive power from either of said transmissions and transmist power to two output shafts; said main drum drive means being an integral, fully portable unit in itself;

a main drawworks drum connected to one of said output shafts of said main drum drive means in driven relationship therewith; and, main drum brake means connected to said main drum and arranged to apply braking forces thereto, said brake means comprising an integral brake system disconnectable from said main drum brake means without disassembly of said integral brake system.

2. The power system of claim 1 further comprising at least one power takeoff system from said prime movers, said power takeoff system arranged to power mud-pumps and auxiliary power driven equipment in association with said drilling rig.

3. The power system of claim 1 further comprising an auxiliary braking system releasably connected to the other of said output shafts of said main drum drive means, said auxiliary braking system comprising hydraulic damping means.

4. The power system of claim 3 further comprising a second auxiliary braking system releasably connected to said main drum and comprising hydraulic damping means.

5. The power system of claim 1 futher comprising catworks drive means drivably connected to said transmission means and having power transfer means from said transmission means to a catworks assembly at the well.

6. The power system of claim 1 wherein each of said power transfer systems comprises:

a housing case;

an input shaft having sprocket means thereon and releasable connections at each end thereof for connection to external power input and output means;

said input shaft ends passing transversely through said housing case and being sealingly and rotatably engaged in the walls of said case;

an output shaft having sprocket means thereon and releasable connections at each end, said output shaft being generally parallel to said input shaft, passing transversely through said housing case, and being sealingly and rotatably engaged in the walls of said case; and, flexible drive means coengaging said sprocket means on said input and output shafts and adapted to transfer power from said input shaft to said output shaft.

7. The power system of claim 6 wherein said power transfer systems number four, said prime movers number six, and said flexible drive means comprises chains engaging said sprockets in driving relationship.

8. The power system of claim 1 wherein said main drum has a brake drum shaft extending outward from said drum at the opposite end from said output shaft connected to said drum, and said main drum brake means comprises:

a cylindrical hub having a central bore therethrough, said hub being located on said brake drum shaft and secured thereto;

an outward extending radial flange formed on said central hub; and, said integral brake system being removably attached to said flange; said brake system comprising: a generally cylindrical brake drum; an inwardly extending radial web formed inside said drum and adapted for releasable attachment to said radial flange;

a plurality of arcuate brake pads arranged to selectively contact said brake drum; generally cylindrical brake band means attached exteriorly to said brake pads and at least partially encircling said brake drum; and, linkage means attached to said brake band means for moving said brake band means and brake pads radially inward and outward to selectively contact said paids with said drum.

9. The power system of claim 1 wherein said prime movers comprise six motors arranged in a plurality of groups, each said group having two or more motors being in generally parallel relationship with each other.

10. The power system of claim 9 wherein said motors are internal combustion engines and said means for receiving and mounting said engines comprise a portable skid for each engine, with each said skid having coolant means, fuel means, and transmission means thereon transportable as a unit with said skid.

11. A compact drilling rig power system quickly disassembled into fully portable, integral sub-components, said power system comprising:

six prime movers arranged in two groups of three;

six portable skid units each adapted to receive one of said prime movers in disengagible connection therewith, and further having power transmission means thereon for transmitting power from said prime mover;

four power transfer assemblies interconnected with said six prime movers and arranged to transfer the power from all six prime movers to a single final output shaft, each said assembly being an integral, sealed, fully portable unit in itself and being quickly and easily disconnectable from said prime movers;

a high speed transmission connected to one end of said final output shaft;

a low speed transmission connected to the opposite end of said final output shaft;

a final drive transfer assembly having input and output shafts passing transversely therethrough interconnected by power transfer means inside said assembly;

first clutch means drivably and releasably connected between said high speed transmission and said final drive input shaft;

second clutch means drivably and releasably connected between said second transmission and said final drive input shaft;

a main drawworks drum drivably connected to said final drive output shaft; and, a main drum brake system connected to said main drum and arranged to apply braking force to said main drum; said main brake system having a removable brake assembly quickly disconnectable therefrom, fully portable as a unit, and easily reconnectable to said brake system.

12. The drilling rig power system of claim 11 wherein said prime movers comprise internal combustion engines and said power transfer assemblies each comprise a case, two parallel rotatable shafts passing transversely through the case and fluidically sealed therewith, and chain drive means in said case, drivable connected to said shafts.

13. The drilling rig power system of claim 12 further comprising first power takeoff means from at least one of said power transfer assemblies adapted to drive auxiliary pumps at the well; and second power takeoff means connected to said final output shaft and arranged to drive a catworks drum on the well platform.

14. The drilling rig power system of claim 13 further comprising auxiliary braking means operably connectable to said main drum and adapted to selectively provide hydraulic damping forces to the rotation of said main drum.

15. The drilling rig power system of claim 14 wherein said six prime movers are arranged in opposing groups of three per group.

* * * * *